United States Patent [19]

Sebald, deceased

[11] Patent Number: 4,519,444

[45] Date of Patent: May 28, 1985

[54] MULTI-UNIT SAMPLE COOLER

[75] Inventor: Joseph F. Sebald, deceased, late of Bloomfield, N.J., by Dorothy D. Sebald, executrix

[73] Assignee: Heat Power Products Corporation, Bloomfield, N.J.

[21] Appl. No.: 517,583

[22] Filed: Jul. 27, 1983

[51] Int. Cl.[3] ..... F24H 3/00

[52] U.S. Cl. ..... 165/47; 165/74; 165/145; 165/160; 165/163

[58] Field of Search ..... 165/47, 73, 74, 160, 165/163, 145

[56] References Cited

U.S. PATENT DOCUMENTS

| | | | |
|---|---|---|---|
| 1,957,779 | 5/1934 | Hoppes | 165/145 |
| 2,022,431 | 11/1935 | Parmelee | 165/163 |
| 2,143,287 | 1/1939 | Smith | 165/163 |
| 2,191,146 | 2/1940 | Mitchell | 165/145 |
| 2,311,190 | 2/1943 | Shaw | 165/160 |
| 2,954,965 | 10/1960 | Sebald | 165/145 |
| 3,991,823 | 11/1976 | Litke et al. | 165/145 |

*Primary Examiner*—Edward G. Favors
*Assistant Examiner*—Steven E. Warner
*Attorney, Agent, or Firm*—Daniel H. Bobis

[57] ABSTRACT

Apparatus in the form of a multi-unit cooler for cooling liquid samples of steam or water in boiler water feed systems or other process apparatus for the purpose of testing or measuring various inorganic and other components of the cooled samples as for example oxygen content, carbonates, sulfates, etc. has an elongated casing which defines a cooling water inlet chamber, a cooling water inlet for delivering cooling water to said cooling water inlet chamber, and a cooling water outlet remote from but in general alignment with the cooling water inlet, a support housing connected to the outside of the elongated casing defines therewith a cooling water outlet chamber and a connecting conduit is provided for connecting the cooling water outlet chamber to the cooling water outlet, a plurality of cylindrical partitions are connected in the elongated casing generally transverse to the longitudinal line thereof and disposed to extend into the cooling water outlet chamber are a plurality of sample cooler assemblies each operatively associated with an associated one of the cylindrical partitions to form cooling water flow passage therethrough for passing cooling water about the sample cooler assemblies, means in the sample cooler assemblies for cooling the samples of steam and water to be tested, and said means having an inlet for the samples to be tested and an outlet for the test samples.

8 Claims, 6 Drawing Figures

MULTI-UNIT SAMPLE COOLER

BACKGROUND OF THE INVENTION

This invention relates generally to heat exchangers and more particularly to a multi-unit sample cooler for on-stream cooling of liquids or vapor samples in boiler feed water systems or other systems where continuous in-line monitoring or process variables is advantageous. For example, a multi-unit sample cooler is suited for a system or process where control over factors such as oxygen content, suspended solids, pH, dissolved carbonate and sulphate salts, in the control water is required; where the water must be tested periodically or continuously without system shut down or intrusion into process lines, and where cooling of the sample to a nominal value or to a value determined by the testing equipment must be achieved.

Multi-unit sample coolers for this type of testing are known as is shown in U.S. Pat. No. 2,954,965. Such units expedite sample taking or monitoring by bringing a plurality of sample lines to a single location. In this type of testing apparatus the samples passing through the multi-unit sample cooler are subjected to a continous flow of cooling fluid so that all water samples are cooled at a uniform rate to a uniform testing temperature.

The fabrication of prior art multi-unit sample coolers has required extensive shop work in order to properly shape the metal parts, to weld the internal partitions so as to create the internal flow chambers, and to weld baffles to direct the flow of cooling fluids through these flow chambers. Additionally extensive machine work has been required in these prior art devices to properly fit the plurality of heads of the respective cooling assemblies which support the coils for cooling the samples, and to provide a fluid tight seal against leakage of the cooling fluid operatively associated with the cooling assemblies for cooling the samples. Additionally, a plurality of fluid tight fittings are also required to seal the entrance and exit lines to the cooling assemblies in the prior art multi-unit sample coolers.

An important aspect of the prior art multi-unit sample coolers was the fact that the cooling water inlet and cooling water outlet were not in alignment, thus making attachment of the unit to the external cooling water source more complicated.

The present invention overcomes these problems by providing a multi-unit sample cooler whose cooling water inlet and cooling water outlet are in alignment with the longitudinal axis of the multi-unit sample cooler, and the plurality of water sample cooling assemblies consist generally of, a simple unitary fitting for direct attachment to the multi-unit sample cooler support housing, and conventional aligned fillings for each of the exist lines for the coils in the water sample cooling assemblies.

More importantly the improved multi-unit sample cooler in accordance with the present invention simplifies and reduces the manufacturing process for the fabrication thereof by establishing a basic unit consisting of an elongated shell or casing which defines the cooling water inlet chamber, a modular support housing fixedly connected to the exterior face of the elongated shell or casing defines the cooling water outlet chamber, a plurality of spaced serially disposed transverse cylindrical partitions fixedly connecting in the elongated shell or casing are sized so that they respectively extend into the cooling water outlet chamber, and a plurality of sample cooler assemblies fixedly connected to the modular support housing coact with the cylindrical partitions to form a corresponding plurality of cooling water flow passages therewith from the cooling water inlet chamber to the cooling water outlet chamber, and this construction permits the cooling water inlet and cooling water outlet to be disposed in alignment with each other so that the multi-unit sample cooler can be easily mounted and connected into the associated system for delivering and removing the cooling water required for operation of the sample cooler unit.

SUMMARY OF THE INVENTION

Thus, the present invention covers an improved multi-unit sample cooler including, an elongated shell or casing defining a cooling water inlet chamber having, a cooling water inlet communicating with the cooling water inlet chamber to deliver cooling water thereto, a cooling water outlet remote from and in general alignment with the cooling water inlet, a modular support housing connected to the elongated casing defines therewith a cooling water outlet chamber, and means forming a connecting conduit between said cooling water outlet chamber and said cooling water outlet is provided for passing the spent cooling water from the multi-unit sample cooler, a plurality of serially disposed hollow cylindrical partitions mounted in fluid tight engagement in the elongated casing transverse to the longitudinal line thereof is sized so that one end extends into the cooling water outlet chamber, said support housing having, spaced openings each aligned respectively with an associated one of said plurality of cylindrical partitions, a plurality of sample cooler assemblies each respectively connected to the support housing and disposed to extend through an associated one of said openings into one of the aligned cylindrical partitions to form therewith a plurality of fluid flow passages to pass cooling water from the cooling water inlet chamber to the cooling water outlet chamber about the respective sample cooler assemblies, and each of said plurality of sample cooler assemblies including a condensing coil disposed in assembled position to lie in an associated one of the plurality of fluid flow passages and having, an inlet for a sample to be cooled and an outlet for the cooled sample.

Accordingly, it is an object of the present invention to provide a multi-unit sample cooler having a cooling water inlet and a cooling water outlet disposed generally in alignment with the longitudinal axis of the mutli-unit sample cooler and with each other.

It is another object of the present invention to provide a multi-unit sample cooler wherein the respective sample cooler assemblies have no fittings inside the shell which are potential sites of corrosion, leakage and contamination.

It is another object of the present invention to provide a multi-unit sample cooler having sample cooler assemblies that are fixedly attached to a supporting head and in assembled position are operatively associated with a cylindrical partition to define a cooling fluid flow passage therewith which eliminates a multiplicity of fluid tight seals in such multi-unit sample cooler.

It is still another object of the present invention to provide a simplified multi-unit sample cooler which can be easily connected and removed from the cooling fluid source and which includes relatively simple sample cooler assembly units easily connected, removed, interchanged, or replaced as may be required.

Further objects and advantages of the present invention will become evident from the following description with reference to the accompanying drawings in which:

DESCRIPTION OF A PREFERRED EMBODIMENT

Figure 1:
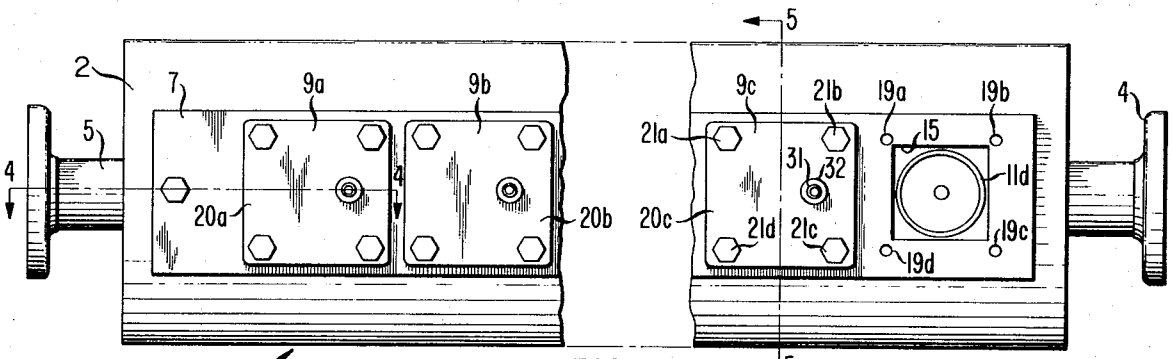
FIG. 1 is a top plan view of a multi-unit sample cooler in accordance with the present invention with one of the sample cooler assemblies removed to show the opening in the support housing which is aligned with the cylindrical partition fixedly connected in the elongated casing for the multi-unit sample cooler.

Referring to the drawings FIGS. 1 to 6 show a preferred embodiment of the multi-unit sample cooler in accordance with the present invention generally designated 1 having an elongated hollow shell or casing 2 which defines therein a cooling water inlet chamber 3. A cooling water inlet 4 at one end of the hollow casing 2 will deliver cooling water from any suitable source, not shown, to the cooling water inlet chamber 3, and a cooling water outlet 5 at the opposite end of the hollow casing 2 disposed in general alignment with the cooling water inlet 4, will pass the spent cooling water from the multi-unit sample cooler as hereinafter more fully described to be passed to any suitable point of return to the cooling water supply system.

The alignment of the cooling water inlet 4 and cooling water outlet 5 provides a simple in line means for connecting the multi-unit sample cooler into the cooling water supply and return system at the site where the multi-unit sample cooler must be used.

Further the elongated casing 2 is provided with a plurality of spaced mounting brackets as at 6 so that the multi-unit sample cooler can be affixed at any suitable operating position.

Fixedly connected as by welding to the exterior of the elongated casing 2 in the longitudinal line thereof is a modular support housing generally designated 7 which as shown at FIGS. 1, 2, 3, 4 and 5 of the drawing forms with the exterior of the elongated casing 2 a cooling water outlet chamber 8 which will be sized to receive all of the cooling water passed from the cooling water inlet chamber 3 through a plurality of water sample cooling assemblies generally designated 9*a*, 9*b* and 9*c* for cooling respectively samples of water to be measured and tested and whose structure and operation is also more fully described below.

Figure 2:
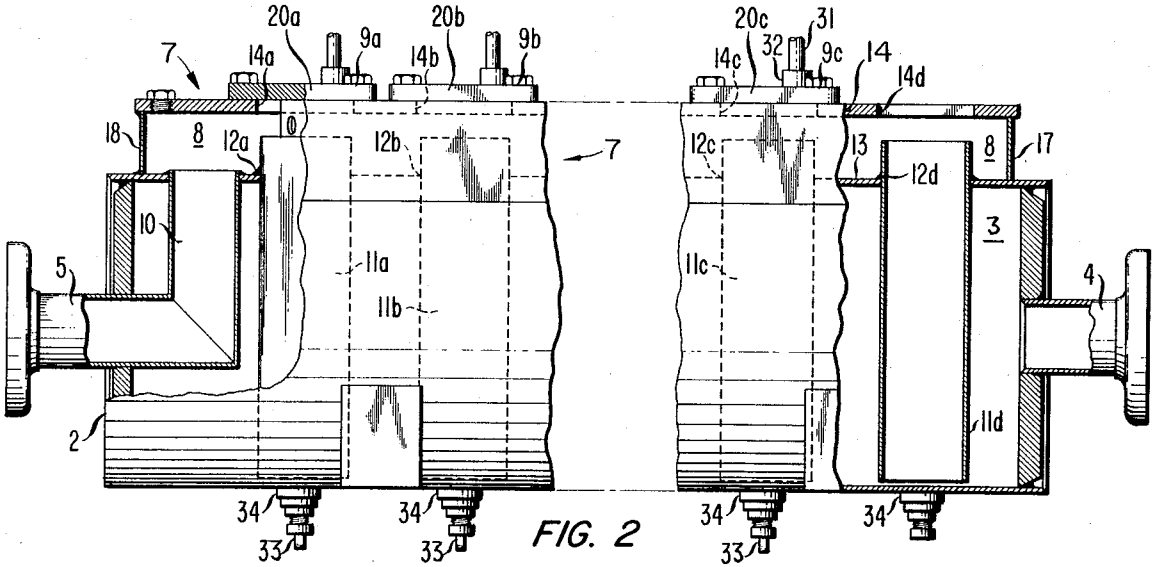
FIG. 2 is a side elevation of the multi-unit sample cooler shown in FIG. 1 broken away at each respective end to show the operative association of at least one sample cooler assembly at one end with the transversely disposed cylindrical partition and at the opposite end to show the means forming the connecting conduit between the cooling water outlet chamber and the cooling water outlet for the multi-unit sample cooler.
Figure 4:
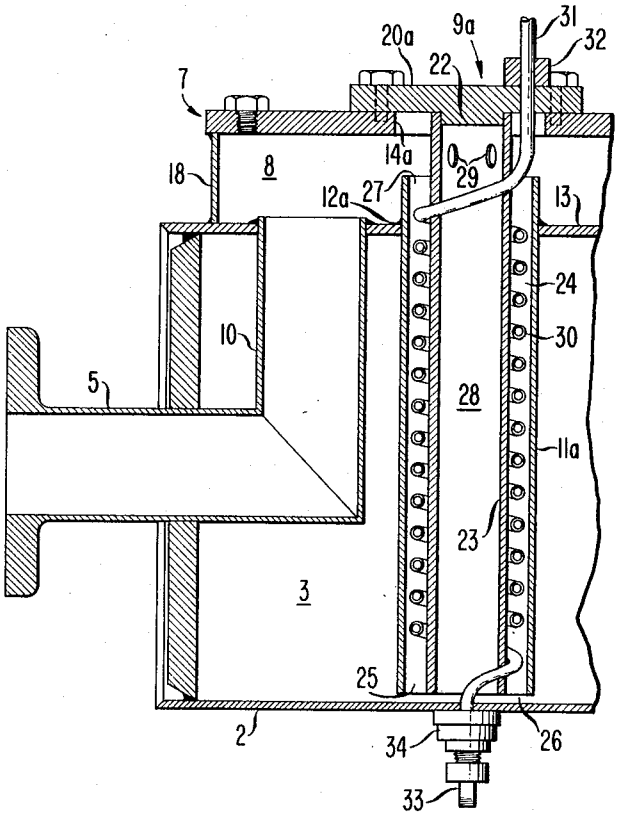
FIG. 4 is an enlarged cross-section of the cooling water outlet end of the multi-unit sample cooler shown in FIGS. 1 and 2.

In order to pass the spent cooling water from the cooling water outlet chamber 8 to the cooling water outlet 5 a connecting conduit means 10 is mounted in the elongated casing 2 so that one end communicates through the wall of the elongated casing 2 with the cooling water outlet chamber 8 and the other end communicates with the cooling water outlet 5 all of which is clearly shown in FIGS. 2 and 4 of the drawings.

The plurality of water sample cooler assembly units 9*a*, 9*b* and 9*c* are operatively associated with a plurality of cylindrical partitions as at 11*a*, 11*b*, 11*c* and 11*d* in a manner which will now be described to enable cooling water to be passed into heat exchange relation with the water sample passing through each respective sample cooler assembly unit.

Thus referring to FIGS. 1 to 6 the plurality of hollow cylindrical partitions 11*a*, 11*b*, 11*c* and 11*d* are shown as elongated members which are fixedly connected as by welding at 12*a*, 12*b*, 12*c* and 12*d* in openings provided in the wall of the elongated casing 2. FIGS. 1, 2, 4 and 5 show that the elongated hollow cylindrical partitions 11*a*, 11*b*, 11*c* and 11*d* are disposed in generally spaced serial relationship to each other and respectively transverse to the longitudinal axis of the elongated casing 2. Each of the cylindrical partitions will have sufficient length to have the lower end disposed in contact with the inner wall of the elongated casing 2 and the upper end disposed to extend a predetermined distance past the exterior of the side wall portion 13 which forms the cooling water outlet chamber 8 with the support housing 7 of the multi-unit sample cooler so that the upper or free end remote from the lower end is disposed a spaced distance from the support head 14 which is formed on the support housing 7 for reasons that will appear clear when the interrelation between the sample cooler assembly units and the cylindrical partitions is hereinafter described.

Figure 5:
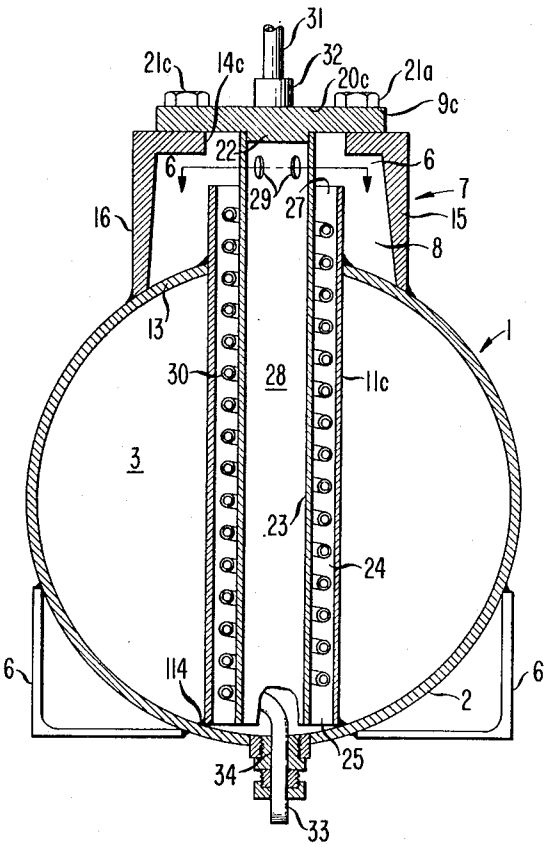
FIG. 5 is a partial cross-section taken on line 5—5 of FIG. 1.

The cylindrical partitions 11*a*, 11*b*, 11*c* and 11*d* can be tack welded as at 114 to prevent undue vibrations during operation of the multi-unit sample cooler 1 as is shown in FIG. 5 of the drawings.

Figure 3:
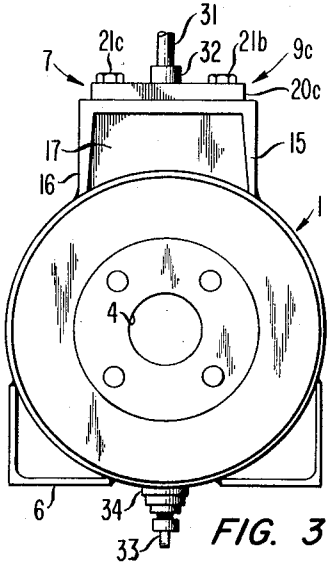
FIG. 3 is a right end view of the multi-unit sample cooler shown in FIG. 1.
Figure 6:
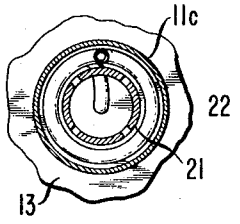
FIG. 6 is a partial cross-section taken on line 6—6 of FIG. 5.

The support head 14 is formed from the upper section of a piece of stock channel having side sections as at 15 and 16 which by proper selection can be sized to establish the desired volumetric capacity of the cooling water outlet chamber when the side sections 15 and 16 are welded to the exterior of the elongated casing 2. This volumetric space defining the cooling water outlet chamber 8 can be simply formed by welding the end section 17 and 18 into position, all of which is shown in FIGS. 2, 3, and 4 of the drawings.

The respective openings 14*a*, 14*b*, 14*c* and 14*d* in the support head 14 are as shown in FIGS. 2, 4 and 5 disposed in general alignment with an associated one of the cylindrical partitions 11*a*, 11*b*, 11*c* and 11*d*. In the support head 14 spaced about each of the openings 14*a*, 14*b*, 14*c* and 14*d* are a plurality of threaded bores as at 19*a*, 19*b*, 19*c* and 19*d* which provide means for connecting the support heads 20*a*, 20*b*, and 20*c* of the sample cooler assemblies 9*a*, 9*b* and 9*c* as by threaded members 21*a*, 21*b*, 21*c* and 21*d* so that each of the sample cooler assemblies in assembled position can extend through its associated one of the openings 14*a*, 14*b*, 14*c* and 14*d* into the associated one of the cylindrical partitions for operation therewith as is shown in FIGS. 2, 4 and 5 of the drawings.

The sample cooler assemblies 9*a*, 9*b* and 9*c* shown are identical in construction to each other and are therefore modular in the sense that each sample cooler assembly may be easily connected, removed or interchanged at the various spaced openings 14*a*, 14*b*, 14*c* and 14*d* in the supporting head 14. Reference will therefore be made only to one of the sample cooler assembly units as for example, unit 9*c* shown at FIG. 5 of the drawings.

Other forms of sample cooler units sized to fit within the dimension of the respective associated cylindrical partitions may be utilized without departing from the scope of the present invention.

Thus, by reference to FIG. 5 the connecting head 20*c* of the sample cooler assembly 9*c* is shown in assembled position on the support head 14 of the support housing 7. Connecting head 20*c* is a sized generally flat platelike member which has a downwardly projecting central section as at 22 to provide means for centering and connecting one end of an annular sleeve 23 to the connecting head 20*c* as by welding. Annular sleeve 23 has a substantially smaller outer diameter than the inner diameter of the associated cylindrical partition 11*c* and a length such that in assembled position it extends the full length of the cylindrical partition and thus the outer diameter of the annular sleeve and the inner diameter of the cylindrical partition define an annular fluid flow passage 24 therebetween which has a lower opening as at 25 disposed to communicate with the cooling water inlet chamber through the clearance as at 26 to permit cooling water to flow upwardly through the annular fluid flow passage and out through the outlet opening 27 formed by the upper free end of the cylindrical partition in the cooling water outlet chamber all of which is shown in FIGS. 4 and 5 of the drawings.

Additionally, cooling water can flow upwardly through the space 28 defined in the central portion of the annular sleeve to pass out through a plurality of exit ports 29 provided adjacent the upper end of the annular sleeve in communication with the cooling water outlet chamber 8. In order to provide means for selecting, cooling and removing the sample of steam or water to be monitored, measured or tested, each sample cooler assembly will be provided with a helically wound sample cooler coil 30 which as shown in FIG. 5 is evenly wound about the exterior of the annular sleeve 23. The helical coil 30 is fastened at the inlet end 31 through a suitable fluid tight inlet connecting fitting 32 and is disposed so that the outlet end 33 can be easily aligned for fluid tight connection with a suitable outlet connecting fitting 34 when the sample cooler assembly is connected in assembled position on the support head 14 of the support housing 7.

The annular sleeve and the helical coil 30 will be so sized that in assembled position the helical coil 30 will lie in the annular fluid flow passage 24 formed between the outer wall of the annular sleeve 23 and the inner wall of the cylindrical partition 11*c* all of which is clearly shown in FIG. 5 of the drawings.

The means for connecting the helical coil into the fluid tight fittings and for holding the same in place are well known to those skilled in the art and hence are not more fully described herein. The entrance position and the exit position of the coils can be easily established for this purpose. It will be readily observed by those skilled in the art that by varying the size of any of the several elements as above described that any desired rate of cooling water flow can be maintained within the limits of the size of the elongated shell or casing 2 and the number of sample cooler assemblies in the multi-unit sample cooler in accordance with the present invention.

The design flow rate of the typical multi-unit sample cooler for a boiler condenser application is approximately five gallons per minute, therefore the cooling water inlet 4 is critical as it controls the volume of the entering coolant. The total cooling capacity is a function of inlet volume and well known calculations for heat exchange relationships can be made to determine the space and volumetric requirements for the desired reduction in temperature of the sample of steam or water to be tested or measured.

OPERATION

In operation the cooling water inlet 4 and cooling water outlet 5 are connected in the cooling water delivery and return lines. Each of the respective sample cooler assemblies may then be connected to a selected steam or process line and the lower or exit end of the helical coil can be connected to a suitable monitoring instrument, not shown, and valve, not shown, for controlling the flow thereof.

The cooling water can flow continuously through the multi-unit sample cooler and thus maintain each of the helical coils 30 in each of the sample cooling assemblies at a predetermined heat exchange capacity so that the samples of steam or water taken off will always come off as the desired temperature for the measurements or tests to be made.

Thus an improved multi-unit sample cooler has been described which has a simple means for connecting the same into the cooling water supply and return system and a simplified means is provided for connecting the sample cooler assemblies such that a unitary coil from inlet end to outlet end without elbows or couplings within the shell is provided which can be interchangeably mounted by means of relatively simple fluid tight coupling assemblies.

It will be understood that the invention is not to be limited to the specific construction or arrangement of parts shown but that they may be widely modified within the invention defined by the claims.

What is claimed is:

1. In a multi-unit sample cooler, a. an elongated casing defining, a cooling water inlet chamber extending end to end in the lengthwise, longitudinal direction of said elongated casing, a cooling water inlet at one end of said casing connected to a source of cooling water and communicating with the cooling water inlet chamber, and a cooling water outlet remote from and in axial alignment with the cooling water inlet at an opposite end, b. a support housing connected to the exterior of the elongated casing and extending substantially end to end in the lengthwise direction of said elongated casing, to define therewith a cooling water outlet chamber, c. means defining a connecting conduit positioned within said cooling water inlet chamber for fluidly connecting said cooling water outlet chamber and said cooling water outlet, d. a plurality of serially disposed elongated cylindrical partitions mounted in fluid tight relationship extending in spaced relation along the longitudinal direction of said elongated casing transverse to the cooling water inlet and outlet axial alignment and disposed to extend within the cooling water inlet chamber and into the cooling water outlet chamber, e. a plurality of serially disposed openings arranged in the longitudinal direction of the elongated casing, each respectively receiving a respective one of said cylindrical partitions, and f. a plurality of sample cooler assemblies each including a sample coil, and each respectively mounted within a respective one of said cylindrical partitions and extending through a respective opening in the support housing in assembled position to form a fluid flow passage with the respective cylindrical partition to permit cooling water to flow about said coil from the cooling water inlet chamber to the cooling water outlet chamber.

2. In a multi-unit sample cooler as claimed in claim 1 wherein said support housing is formed from modular stock material to provide the desired volumetric capacity for the cooling water outlet chamber.

3. In the multi-unit sample cooler as claimed in claim 2 wherein the modular stock material is a sized channel member, and an end member is connected to the support housing and the elongated casing to form the cooling water outlet chamber.

4. In the multi-unit sample cooler as claimed in claim 1 wherein, a. each of said plurality of sample cooler assemblies has an annular member thereon disposed inwardly of the sample coil, and b. each of said sample cooler assemblies in assembled position in a respective one of the plurality of cylindrical partitions is disposed so that an outer wall of the annular member and an inner wall of the cylindrical partition form the fluid flow passage therebetween and said sample coil is disposed in said fluid flow passage.

5. In the multi-unit sample cooler as claimed in claim 1 wherein, a. the elongated casing has, a side wall, b. said elongated casing is provided with a plurality of serially spaced openings arranged in the longitudinal direction in said side wall, c. the plurality of serially disposed elongated cylindrical partitions are each respectively mounted in an associated spaced opening in said side wall, and d. the respective cylindrical partitions are welded to the side wall about the associated opening therein.

6. In the multi-unit sample cooler as claimed in claim 5 wherein the cylindrical partitions are tack welded in the elongated casing adjacent lower ends thereof.

7. In the multi-unit sample cooler as claimed in claim 1 wherein, a. an upper end of each cylindrical partition is disposed a predetermined distance into the cooling water outlet chamber to provide a sized flow opening, and b. said sized flow opening being a function of a sized outlet for the fluid flow passage.

8. In the multi-unit sample cooler as claimed in claim 1 wherein each of the coils in each respective sample cooler assembly has an inlet for a fluid sample to be cooled, and an outlet for each cooled sample.

* * * * *